US009444178B2

(12) United States Patent
Arai et al.

(10) Patent No.: US 9,444,178 B2
(45) Date of Patent: Sep. 13, 2016

(54) WATERPROOF CONNECTOR HAVING A HOUSING WITH AN ELASTIC MEMBER ELASTICALLY COMPRESSED INTO AN OPENING IN THE HOUSING

(71) Applicant: Japan Aviation Electronics Industry, Limited, Tokyo (JP)

(72) Inventors: Katsumi Arai, Tokyo (JP); Hiroshi Akimoto, Tokyo (JP); Masayuki Nishikata, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/401,077

(22) PCT Filed: Feb. 21, 2013

(86) PCT No.: PCT/JP2013/054287
§ 371 (c)(1),
(2) Date: Nov. 13, 2014

(87) PCT Pub. No.: WO2013/172067
PCT Pub. Date: Nov. 21, 2013

(65) Prior Publication Data

US 2015/0180158 A1 Jun. 25, 2015

(30) Foreign Application Priority Data

May 17, 2012 (JP) ..... 2012-113433

(51) Int. Cl.
*H01R 13/40* (2006.01)
*H01R 13/52* (2006.01)
*H01R 12/72* (2011.01)

(52) U.S. Cl.
CPC ..... *H01R 13/521* (2013.01); *H01R 13/5216* (2013.01); *H01R 12/724* (2013.01); *H01R 2201/16* (2013.01)

(58) Field of Classification Search
CPC H01R 13/52; H01R 13/521; H01R 13/5216; H01R 13/5221
USPC ..... 439/271–275, 587–588
See application file for complete search history.

(56) References Cited

U.S. PATENT DOCUMENTS 5,597,324 A * 1/1997 Katsunori ..... H01R 13/5208 439/587
2015/0207264 A1* 7/2015 Arai ..... H01R 13/405 439/660

FOREIGN PATENT DOCUMENTS

JP 7-114950 A 5/1995
JP 2005-317498 A 11/2005

(Continued)

OTHER PUBLICATIONS

Notification of Transmittal of Translation of The International Preliminary Report (PCT/IB/338).

(Continued)

*Primary Examiner* — Chandrika Prasad
(74) *Attorney, Agent, or Firm* — Muncy, Geissler, Olds & Lowe, P.C.

(57) ABSTRACT

A waterproof connector, provided with: a housing (11); at least one contact (12) fixed to the housing (11), each contact (12) having a contacting part (12*a*) which is formed at one end and which comes into contact with the contact of the counterpart connector, a substrate attachment part (12*d*) formed at the other end and attached to the substrate, a housing fixing part (12*b*) formed between the contacting part (12*a*) and the substrate attachment part (12*d*), and an elastic member attachment part (12*c*) formed between the housing fixing part (12*b*) and the substrate attachment part (12*d*); and a waterproofing elastic member (13) attached to the elastic member attachment part (12*c*) of the contact (12). The housing (11) has at least one through-hole (16) into which the contact (12) is inserted, and a concave elastic member containing part (15) communicating with the through-hole (16). The housing fixing part (12*b*) of the contact (12) is pressed into and fixed in the corresponding through-hole (16) of the housing (11), and the elastic member (13) is contained in the elastic member containing part (15) of the housing (11).

15 Claims, 8 Drawing Sheets

(56) References Cited

FOREIGN PATENT DOCUMENTS

| | | | |
|---|---|---|---|
| JP | 2008-176936 | A | 7/2008 |
| JP | 2008-243745 | A | 10/2008 |
| JP | 2011-249311 | A | 12/2011 |
| JP | 2012-9358 | A | 1/2012 |

OTHER PUBLICATIONS

International Preliminary Report on Patentability (PCT/IB/373).
Written Opinion of The International Searching Authority (PCT/ISA/237).

* cited by examiner

WATERPROOF CONNECTOR HAVING A HOUSING WITH AN ELASTIC MEMBER ELASTICALLY COMPRESSED INTO AN OPENING IN THE HOUSING

TECHNICAL FIELD

The present invention relates to a waterproof connector, in particular, to a waterproof connector which uses an elastic member for waterproofing and is to be mounted on a board.

BACKGROUND ART

Recently, there is a strong demand for the improved waterproof function in various electronic devices, and accordingly developments of waterproof connectors have been promoted In an exemplary waterproof connector, a contact is attached so as to penetrate through a housing, and a contact portion of the contact exposed to the outside of the housing is brought into contact with another contact of a counter connector. In the waterproof connector of this type, a penetration part in which the contact penetrates has to be sealed to secure a waterproof function.

For example, Patent Literature 1 discloses a waterproof connector in which a contact 1 penetrates through a housing 2, and a peripheral region of the penetration part of the contact 1 is sealed with an elastic sealing member 3 as illustrated in FIG. 25.

The contact 1 is pressed into a through-hole 4 formed in the housing 2 and fixed to the housing 2, and a contact portion 5 of the contact 1 exposed to the outside of the housing 2 comes into contact with a contact 6 of a counter connector, thereby establishing electrical connection with the counter connector. An end portion of the contact 1 projecting inside the housing 2 is attached to a board or the like disposed in the housing 2.

The elastic sealing member 3 is pressed into an elastic-sealing-member accommodation portion 7 that is formed in the housing 2 and communicates with the through-hole 4 so as to prevent water from intruding into the housing 2 through a gap between the contact 1 and an inner wall of the through-hole 4.

CITATION LIST

Patent Literature

Patent Literature 1 : JP 2008-176936 A

SUMMARY OF INVENTION

Technical Problems

In the connector disclosed in Patent Literature 1, the contact 1 is fixed at a part of the housing 2 where the contact 1 is pressed into the through-hole 4 of the housing 2 as described above, and in order to achieve a waterproof function, the elastic sealing member 3 is disposed outside of the housing 2, while the contact portion 5 of the contact 1 is disposed further outside the elastic sealing member 3. Accordingly, the distance from the part of the housing 2 where the contact 1 is fixed to the contact. portion. 5 of the contact 1 becomes inevitably long, and the contact portion 5 is thus likely to become shaky.

If the contact portion 5 of the contact 1 shakes and the position of the contact portion 5 does not stabilize, smooth fitting as well as reliable electrical connection with the counter connector may become difficult.

The present invention has been made in order to solve the problem described above and an object of the present invention is to provide a waterproof connector capable of smooth fitting as well as reliable electrical connection with a counter connector while fulfilling a waterproof function.

Solution to Problems

A waterproof connector according to the present invention comprises: a housing; at least one contact held by the housing, the contact including a contact portion formed at one end of the contact to come into contact with another contact of a counter-connector, a board attachment portion formed at another end of the contact to be attached to a board, a housing fixing portion formed between the contact portion and the board attachment portion and fixed to the housing; and an elastic-member attachment portion formed between the housing fixing portion and the board attachment portion, wherein the housing has at least one through-hole through which the contact is inserted, and an elastic-member accommodation portion which has a concave shape and communicates with the through-hole, and wherein the housing fixing portion of the contact is pressed into and fixed in the corresponding through-hole of the housing, and the elastic member is accommodated in the elastic-member accommodation portion of the housing.

Preferably, the elastic member is integrally molded with the elastic-member attachment portion of the contact. Otherwise, the elastic member may have at least one slit for attaching the elastic member to the elastic-member attachment portion of the contact and is attached to the elastic-member attachment portion of the contact laterally through the slit that is opened.

It is preferable that the elastic-member attachment portion of the contact has a roughened surface or the elastic member is adhered to the elastic-member attachment portion of the contact with an adhesive.

The elastic-member attachment portion of the contact may have a smaller cross section than cross sections of other portions of the contact adjacent to the elastic-member attachment portion.

The elastic-member attachment portion of the contact may have a bent portion, and the elastic member may be attached to the elastic-member attachment portion so as to surround the bent portion.

The elastic member may be singly attached to a plurality of the contacts.

It may be constructed that the contact is formed of a flat plate member, and the housing fixing portion of the contact has a press-fitting dimension in a width direction larger than a width of the through-hole of the housing. In this case, the housing fixing portion of the contact is preferably provided with convexity and concavity on its side surfaces in a width direction.

It may also be constructed that The contact is formed of a flat plate member, and the housing fixing portion of the contact has a press-fitting dimension in a thickness direction larger than a height of the through-hole of the housing. In this case, the housing fixing portion of the contact is preferably formed to be thicker than other portions of the contact, and the press-fitting dimension is established by a thickness of the housing fixing portion. Otherwise, the flat plate member having a uniform thickness may be bent, thereby establishing the press-fitting dimension of the housing fixing portion of the contact.

Further, the housing preferably has at least one groove to accommodate the contact portion of the contact. The groove may have a sectional shape that covers both edge portions of the contact portion of the corresponding contact while allowing a center portion of a surface of the contact portion to be exposed.

It may be constructed that either one of the elastic-member accommodation portion of the housing and the elastic member is provided with a concave portion, whereas another one is provided with a convex portion corresponding to the concave portion, and the concave portion and the convex portion are fitted with each other. It may also be constructed that the elastic-member accommodation portion of the housing has an opening portion and an end portion formed to be wider than the opening portion, and the elastic member has a sectional shape corresponding to the elastic-member accommodation portion of the housing.

ADVANTAGEOUS EFFECTS OF INVENTION

According to the present invention, a housing fixing portion is formed. between the contact portion and the board attachment portion, an elastic-member attachment portion is formed between the housing fixing portion and the board attachment portion, the housing fixing portion of the contact is pressed into and fixed in the through-hole of the housing, and an elastic member for waterproofing attached to the elastic-member attachment portion of the contact is accommodated in the elastic-member accommodation portion of the housing. Therefore, it is capable of smooth fitting as well as reliable electrical connection with a counter connector while fulfilling a waterproof function.

FIG, 22 is a perspective view illustrating how to incorporate contacts into a housing according to the other variation of Embodiment 5.

Figure 23:
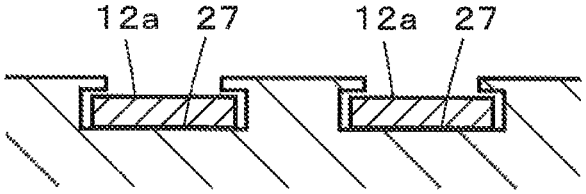

FIG. 23 is a cross-sectional view illustrating the state in which contact portions of contacts are accommodated in grooves of a housing according to another embodiment.

Figure 24:
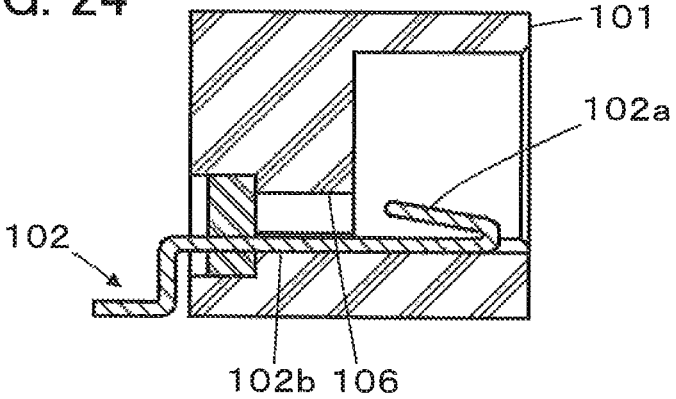

FIG. 24 is a cross-sectional view of a waterproof connector according to yet another embodiment.

Figure 25:
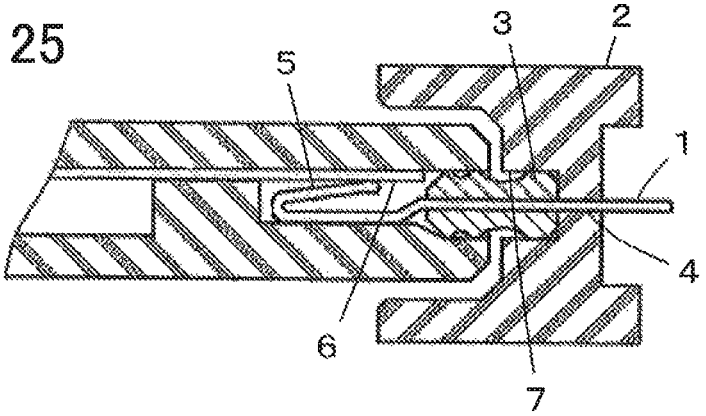

FIG. 25 is a cross-sectional view of a structure of a conventional waterproof connector.

DESCRIPTION OF EMBODIMENTS

Embodiments of the present invention will be described below based on the appended drawings.

Embodiment 1

Figure 1:
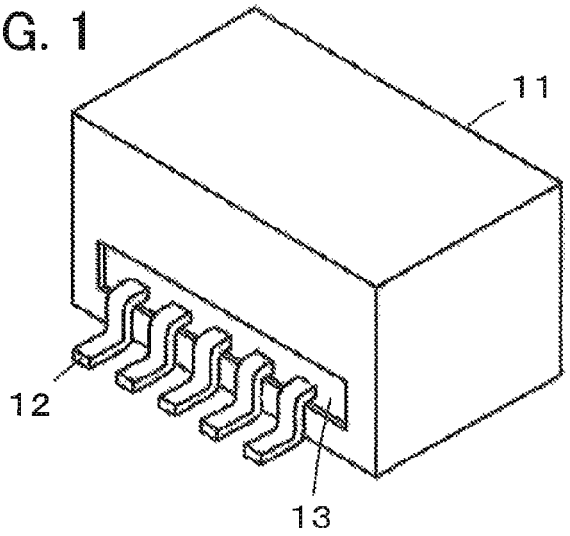
FIG. 1 is a perspective view of a waterproof connector according to Embodiment 1 of the present invention.

FIG. 1 illustrates a structure of a waterproof connector according to Embodiment 1 of the present invention. The waterproof connector includes a housing 11 having a cuboid outer shape and a plurality of contacts 12 fixed to the housing 11. A single common elastic member 13 for waterproofing is attached to the plurality of contacts 12, and the plurality of contacts 12 are attached to the housing 11 together with the elastic member 13.

Figure 2:
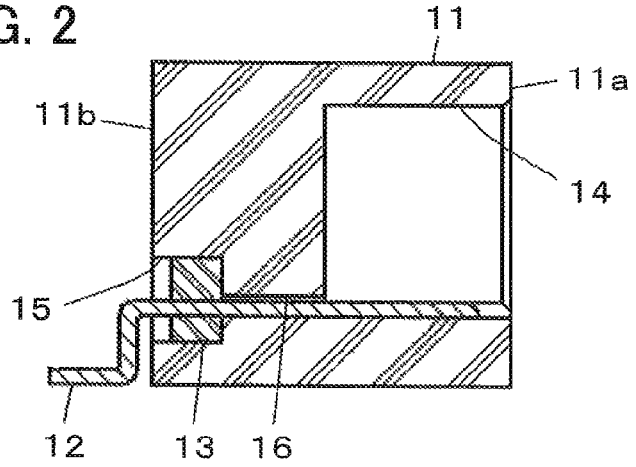
FIG. 2 is a cross-sectional view of the waterproof connector according to Embodiment 1.

As illustrated in FIG. 2, the housing 11 is provided with a counter-connector receiving portion 14 in a concave shape opening in a front face 11*a* of the housing 11 and an elastic-member accommodation portion 15 in a concave shape opening in a rear face 11*b* of the housing 11. The counter-connector receiving portion 14 is a space for receiving a counter connector which is to be fitted with the waterproof connector according to Embodiment 1, whereas the elastic-member accommodation portion 15 is a space for accommodating the elastic member 13 which is attached to the plurality of contacts 12 and is pressed into the elastic-member accommodation portion 15. The housing 11 is further provided with a plurality of through-holes 16 that correspond to the plurality of contacts 12 and connect the counter-connector receiving portion 14 with the elastic-member accommodation portion 15. The contacts 12 are inserted into the corresponding through-holes 16, respectively.

Figure 3:
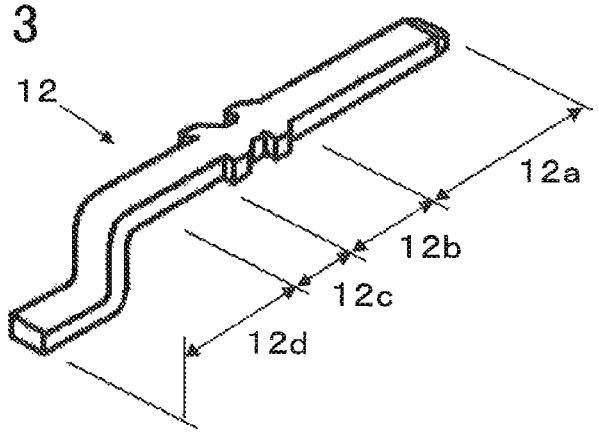
FIG. 3 is a perspective view of a contact used in the waterproof connector according to Embodiment 1.

Each of the contacts 12 is formed of a flat plate member and is provided with a contact portion 12*a* to come into contact with a contact of the counter connector, a housing fixing portion 12*b* for fixing the contact 12 to the housing 11, an elastic-member attachment portion 12*c* to which the elastic member 13 is attached, and a board attachment portion 12*d* for attaching the contact. 12 to a board on which the waterproof connector is to be mounted, these portions being continuously formed at the contact 12 from its tip end to its rear end, as illustrated in FIG. 3. That is, the housing fixing portion 12*b* is located between the contact portion 12*a* formed at the tip end and the board attachment portion 12*d* formed at the rear end, and in addition the elastic-member attachment portion 12*c* is located between the housing fixing portion 12*b* and the board attachment portion 12*d*.

In addition, each of the contacts 12 has a uniform thickness over the whole length, and also has a uniform width in the contact portion 12*a*, the elastic-member attachment portion 12*c* and the board attachment portion 12*d*, except the housing fixing portion 12*b*. Each of the side surfaces of the housing fixing portion 12*b* is formed to have a concave-convex shape, and the housing fixing portion 12*b* has the maximum width that is larger than the width of other portions, i.e., the contact portion 12*a*, the elastic-member attachment portion 12*c* and the board attachment portion 12*d*.

Moreover, the contact portion 12*a*, the housing fixing portion 12*b* and the elastic-member attachment portion 12*c* are formed in a same plane so as to form a continuous flat plate. The board attachment portion 12*d*, on the other hand, has a bent shape for easy attachment to a board.

Figure 4:
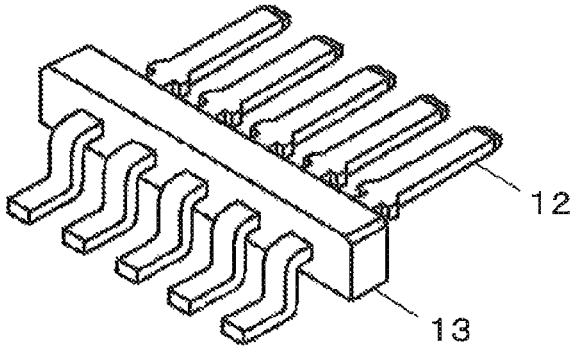
FIG. 4 is a perspective view illustrating the state in which a single elastic member is attached to a plurality of contacts.

As illustrated in FIG. 4, the single elastic member 13 is attached to the plurality of contacts 12 each having the above-described shape. The elastic member 13 is integrally molded with the elastic-member attachment portions 12*c* of the plurality of contacts 12 through, for example, insert-molding. If the contact portion 12*a* to the elastic-member attachment portion 12*c* of each of the contacts 12 is inserted into an attachment hole formed in the elastic member in an attempt to fit the contacts 12 in the elastic member, the contact portion 12*a* may be damaged or contaminated by coming into contact with the elastic member. In this embodiment, however, since the elastic member 13 is integrally molded with the plurality of contacts 12, the contact portion 12*a* of each of the contacts 12 is free of contamination or damage, and reliable electrical connection with the contact of the counter connector can be ensured.

Figure 5:
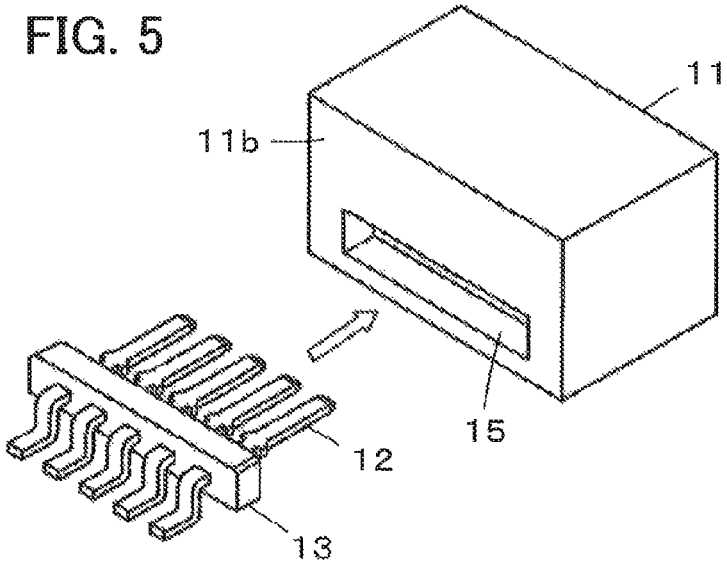
FIG. 5 is a perspective view illustrating how to incorporate the contacts into a housing.
Figure 6:
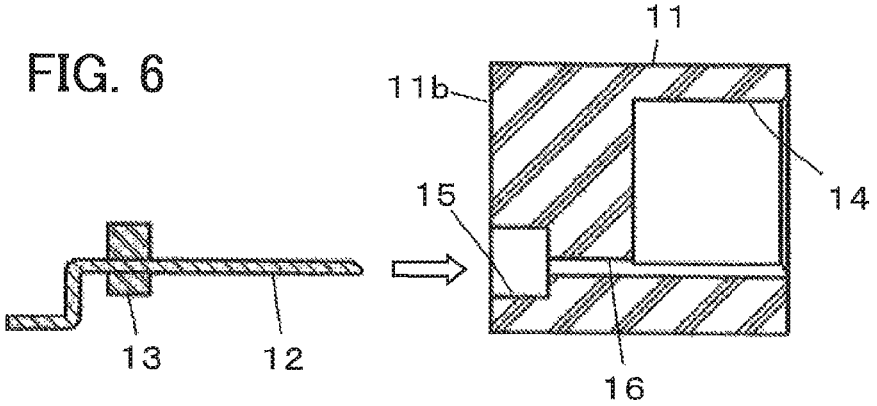
FIG. 6 is a cross-sectional view illustrating how to incorporate the contacts into the housing.

As illustrated in FIGS. 5 and 6, the plurality of contacts 12 with which the elastic member 13 is integrally molded are inserted from the contact portion 12*a* side into the housing 11 through the elastic-member accommodation portion 15 opening in the rear face 11*b* of the housing 11, whereby the waterproof connector is assembled.

Figure 7:
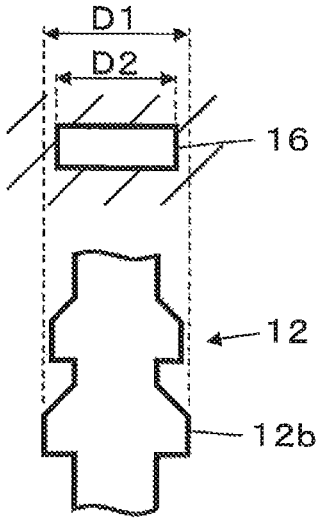
FIG. 7 is a diagram illustrating the relation between a housing fixing portion of the contact and a through-hole in the housing.

In this process, the plurality of contacts 12 are respectively inserted into the corresponding through-holes 16 after passing through the elastic-member accommodation portion 15. The maximum width D1 of the housing fixing portion 12*b* of each of the contacts 12, i.e., the press-fitting dimension in the width direction of the contact 12 is preliminarily set to be slightly larger than a width D2 of the through-hole 16 as illustrated in FIG. 7. Accordingly, during insertion of the contacts 12, at the time when the housing fixing portions 12*b*, following the contact portions 12*a*, reach the entrances of the through-holes 16 of the housing 11, a certain pressure is applied to press the contacts 12 into the housing 11, whereby the both side surfaces having the concave-convex shape of each of the housing fixing portions 12*b* bite into the inner wall of the corresponding through-hole 16. As a result, the housing fixing portions 12*h* are pressed into the through-holes 16.

When the housing fixing portions 12*b* are pressed in, the elastic member 13 integrally molded with the elastic-member attachment portions 12*c* of the plurality of contacts 12 is simultaneously accommodated in the elastic-member accommodation portion 15 of the housing 11. The elastic member 13 is preliminarily formed to have a larger width and a larger height than those of the elastic-member accommodation portion 15 of the housing 11. Therefore, by being pressed into the elastic-member accommodation portion 15, the elastic member 13 is accommodated in the elastic-member accommodation portion 15 in an elastically compressed state. Accordingly, a waterproof effect is imparted between the housing 11 and the contacts 12 in the elastic-member accommodation portion 15.

As described above, the waterproof connector in which the plurality of contacts 12 and the elastic member 13 are incorporated in the housing 11 is formed as illustrated in FIGS. 1 and 2.

Figure 8:
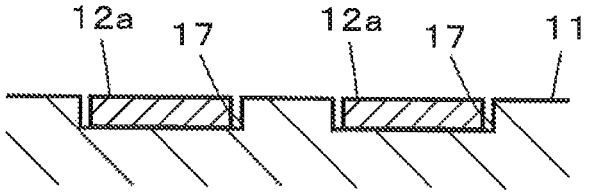
FIG. 8 is a cross-sectional view illustrating the state in which contact portions of the contacts are accommodated in grooves of the housing.

The bottom part of the housing 11 inside the counter-connector receiving portion 14 is provided with a plurality of grooves 17 corresponding to the plurality of contacts 12 as illustrated in FIG. 8, and the contact portions 12*a* of the plurality of contacts 12 are respectively accommodated in the corresponding grooves 17. Hence, even if a stress is applied on the contact portion 12*a* of any of the contacts 12 in the direction toward an adjacent contact 12 due to some cause at the time of fitting with the counter connector or the like, the corresponding groove 17 restricts shifting of the contact portion 12*a*, thereby preventing defects such as a short-circuit between adjacent contacts 12.

The housing 11 can be formed of, for example, a resin material excellent in insulation property and formability, and the contacts 12 can be made of a metal material excellent in conductivity. The elastic member 13 can adopt, for example, a silicone rubber excellent in elasticity and waterproof property.

Figure 9:
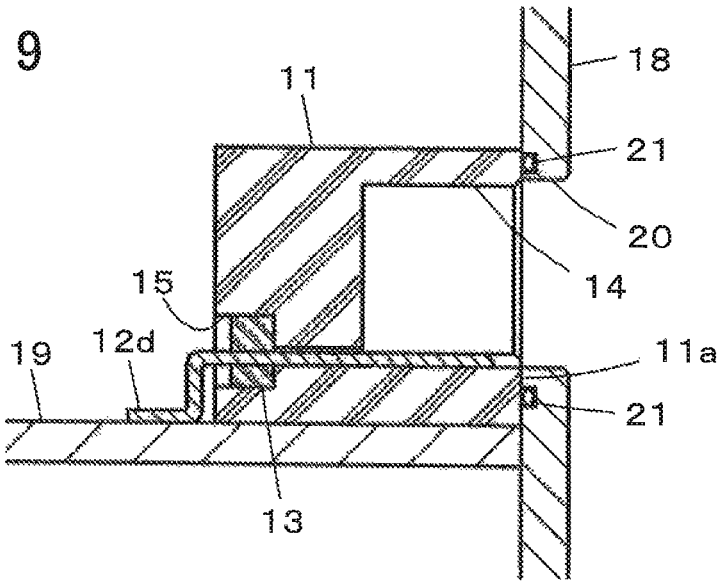
FIG. 9 is a cross-sectional view illustrating the state in which the waterproof connector according to Embodiment 1 is mounted on a board.

As exemplified in FIG. 9 the waterproof connector according to the embodiment is mounted on a board 19 attached within a casing 18 of an electronic device such as a mobile phone. The casing 18 is provided with an opening portion 20 corresponding to the counter-connector receiving portion 14 of the housing 11, and a gasket 21 is disposed on the periphery of the opening portion 20 to seal between an inner face of the casing 18 and the front face 11*a* of the housing 11.

The constitution described above can prevent moisture existing outside the casing 18 from intruding thereinto through the elastic-member accommodation portion 15 of the housing 11 owing to the elastic member 13 and also through a gap between the casing 18 and the housing 11 owing to the gasket 21, thereby achieving a waterproof function.

In Embodiment 1, the contacts 12 are fixed to the housing 11 by means of the housing fixing portions 12*b* being pressed into The corresponding through-holes 16. Since the housing fixing portion 12*b* is disposed adjacent to the contact portion 12*a* in each of the contacts 12 with a small distance, the contact portion 12*a* hardly shakes, stabilizing the position of the contact portion 12*a* with respect to the housing 11. Accordingly, the waterproof connector can be smoothly fitted with the counter connector and can establish reliable electrical connection therewith.

Here, FIGS. 1, 4 and 5 illustrate that five contacts 12 are attached to the housing 11. However, the number of the contacts 12 is not particularly limited to five but can be one to four or six or more.

In addition, instead of integrally molding the single elastic member 13 with all of the plurality of contacts 12, the elastic member may be separated into a plurality of pieces, and each of the pieces may be integrally molded with the corresponding contact 12. In this case, a plurality of elastic members may be accommodated in the single elastic-member accommodation portion 15 of the housing 11, or, alternatively, a plurality of elastic-member accommodation portions may be formed in the housing 11 to respectively accommodate the corresponding elastic members. One contact 12 and one elastic member 13 may be also integrally molded.

Embodiment 2

Figure 10:
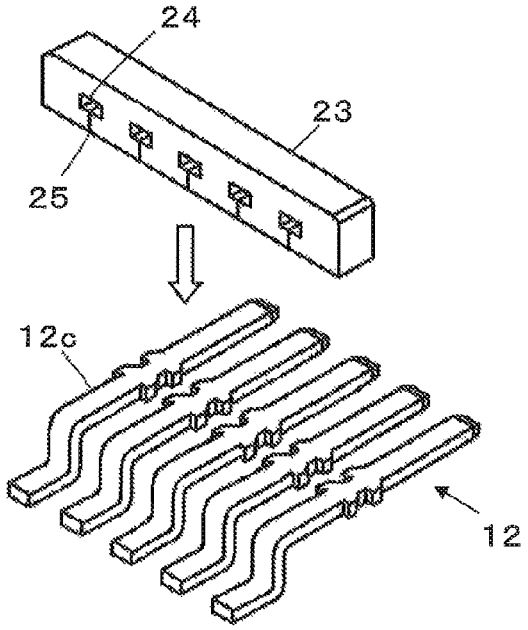
FIG. 10 is a perspective view of an elastic member and contacts used in a waterproof connector according to Embodiment 2.

In Embodiment 1 described above, the elastic member 13 is integrally molded with the elastic-member attachment portions 12*c* of the plurality of contacts 12. Meanwhile, as illustrated in FIG. 10, a plurality of attachment holes 24 corresponding to the plurality of contacts 12 can be formed in an elastic member 23, and a plurality of slits 25 respectively connected to the plurality of attachment holes 24 can be formed, whereby the slits 25 are elastically opened to allow the elastic-member attachment portions 12*c* of the corresponding contacts 12 to be inserted into the attachment holes 24. In other words, the elastic member 23 is attached to the elastic-member attachment portions 12*c* of the contacts 12 laterally through the slits 25 that are opened, not by means of insertion of the contacts 12 from the contact portions 12*a* through the elastic-member attachment portions 12*c* into the attachment holes 24 of the elastic member 23 to fit the contacts 12 into the elastic member 23.

As the elastic member 23 is pressed into the elastic-member accommodation portion 15 of the housing 11, the slits 25 are closed, causing the elastic member to firmly attach to the elastic-member attachment portions 12*c* of the contacts 12. A waterproof effect can be exercised in this manner.

The elastic member 23 having such constitution can be also used and can ensure reliable electrical connection with the contact of the counter connector without contamination or damage on the contact portions 12*a* of the contacts 12, like in the case of using the elastic member 13 according to Embodiment 1.

Embodiment 3

Figure 11:
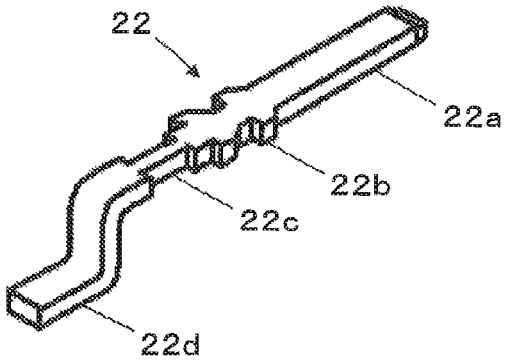
FIG. 11 is a perspective view of a contact used in a waterproof connector according to Embodiment 3.
Figure 12:
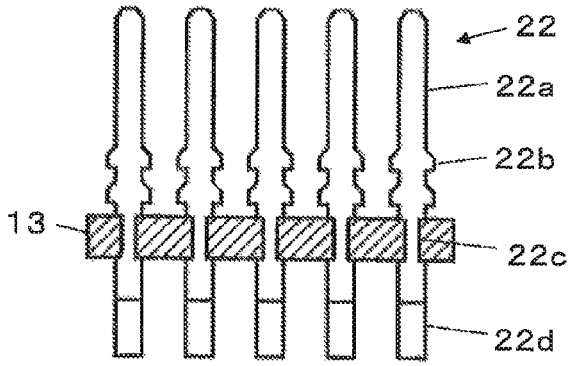
FIG. 12 is a cross-sectional view illustrating the state in which a single elastic member is attached to a plurality of contacts according to Embodiment 3.

FIG. 11 illustrates a structure of a contact 22 used in a waterproof connector according to Embodiment 3. Similarly to the contact 12 illustrated in FIG. 3, the contact 22 is formed of a flat plate member having a uniform thickness and is provided with a contact portion 22*a*, a housing fixing portion. 22*b*, an elastic-member attachment portion 22*c* and a board attachment portion 22*d* that are formed continuously at the contact 22 from its tip end to its rear end, while the elastic-member attachment portion 22*c* is formed to have a smaller width than widths of the contact portion 22*a*, the housing fixing portion 22*b* and the board attachment portion 22*d*. As illustrated in FIG. 12, an elastic member 13 is integrally molded with a plurality of elastic-member attachment portions 22*c* having a small width.

Since each of the elastic-member attachment portions 22*c* is formed to have a narrower width than that of any other portion, even if a stress is applied between the elastic member 13 and the contacts 12 in a direction to pull them out from each other, the elastic member 13 can be effectively prevented from coming off the contacts 22, thereby improving reliability of the waterproof connector.

As long as the elastic-member attachment portion 22*c* has a smaller cross section than those of other adjacent portions of each of the contacts 22, the elastic member 13 can be kept from coming off the contacts 22. Hence, also when the elastic-member attachment portion 22*c* is formed to have the same width as those of other portions but to be thinner than other portions, the same effect can be obtained. In addition, the elastic-member attachment portion. 22*c* can be formed to have both a smaller width and a thinner thickness than those of other portions.

Also in the case where, in place of an integrally-molded elastic member 13, the elastic member 23 provided with the attachment holes 24 and the slits 25 as illustrated in FIG. 10 is attached to the elastic-member attachment portions 22*c* of the contacts 22, the elastic member 23 can be similarly prevented from coming off the contacts 22 in an effective manner, thereby improving reliability of the waterproof connector.

Figure 13:
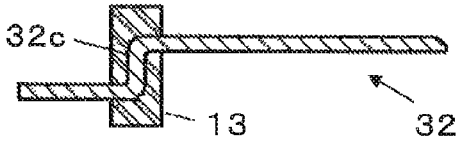
FIG. 13 is a cross-sectional view illustrating a contact and an elastic member used in a waterproof connector according to a variation of Embodiment 3.

Further, if a bent portion is formed at an elastic-member attachment portion 32*c* like in a contact 32 illustrated in FIG. 13 and the elastic member 13 is integrally molded so as to surround the bent portion of the elastic-member attachment portion 32*c*, the elastic member 13 can be also prevented from coming off the contacts 32.

Moreover, by having a surface of the elastic-member attachment portion 12*c* of the contact 12 illustrated in FIG. 3 roughened as well as by using the elastic member 13 integrally molded with the elastic-member attachment portions 12*c* or attaching the elastic member 23 to the elastic-member attachment portions 12*c*, an effect of preventing the elastic member 13 or 23 from coming off the contacts 12 can be also obtained. The surface of the elastic-member attachment portion 22*c* of the contact 22 illustrated in FIG. 11 and the surface of the elastic-member attachment portion 32*c* of the contact 32 illustrated in FIG. 13 can be also roughened.

In the case where the elastic member 23 is attached to the contacts 12 or 22 by means of the slits 25, the elastic member 23 can be adhered to the elastic-member attachment portions 12*c* of the contacts 12 or to the elastic-member attachment portions 22*c* of the contacts 22 with an adhesive. Accordingly, the waterproofing property can be enhanced while the effect of preventing the elastic member 23 from coming off the contacts 12 or 22 can be efficiently achieved.

Embodiment 4

In Embodiment 1 described above, since the housing fixing portion 12*b* of each of the contacts 12 has a press-fitting dimension in the width direction larger than the width of the through-hole 16, and both side surfaces having a concave-convex shape of the housing fixing tort ion 12*h* bite into the inner wall of the through-hole 16, the housing fixing portion 12*b* is pressed into and fixed in the through-hole 16. However, this is not the sole case, and even if the housing fixing portion of each of the contacts has a press-fitting dimension in the thickness direction larger than the height of the through-hole 16, the contact can be pressed into and fixed in the through-hole 16.

Figure 14:
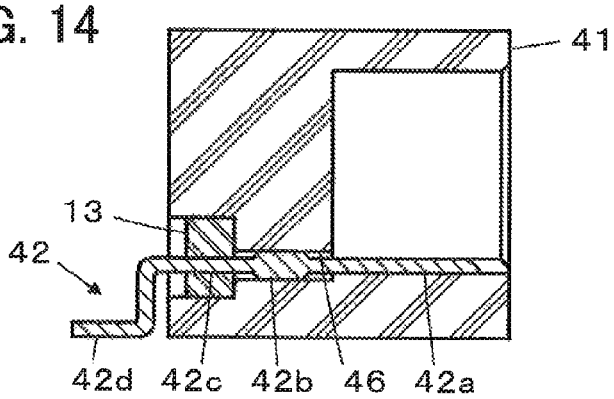
FIG. 14 is a cross-sectional view of a waterproof connector according to Embodiment 4.

FIG. 14 illustrates a structure of a waterproof connector according to Embodiment 4. Similarly to the contact 12 illustrated in FIG. 3, a contact 42 used in the waterproof connector is formed of a flat plate member and is provided with a contact portion 42*a*, a housing fixing portion 42*b*, an elastic-member attachment portion 42*c* and a board attachment portion 42*d* that are formed at the contact 42 continuously from its tip end to its rear end. On the other hand, the housing fixing portion 42*h* has a larger thickness than thicknesses of the contact portion 42*a*, the elastic-member attachment portion 42*c* and the board attachment portion 42*d*, while the thickness of the housing fixing portion 42*h* constitutes the press-fitting dimension in the thickness direction.

The thickness of the housing fixing portion 42*b* is designed to be slightly larger than the height of the through-hole 46 formed in a housing 41, and as the upper surface and the lower surface of the housing fixing portion 42*b* are respectively brought into pressure contact with the ceiling surface and the bottom surface of the through-hole 46, the housing fixing portion 42*b* is pressed into and fixed in the through-hole 46.

The width of the contact 42 only requires to be smaller than that of the through-hole 46 so that the contact 42 can be inserted into the through-hole 46, and the contact 42 can have a uniform width over its full length, for example.

Figure 15:
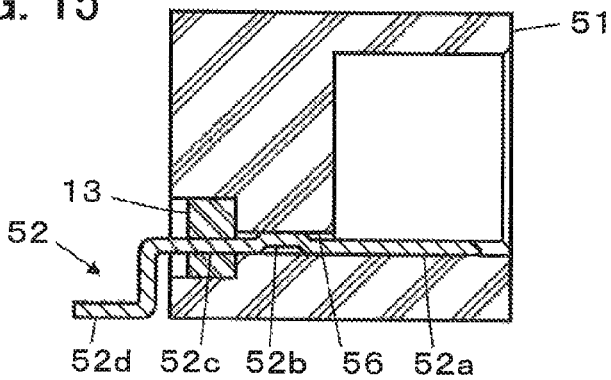
FIG. 15 is a cross-sectional view of a waterproof connector according to a variation of Embodiment 4.

While a contact 52 illustrated in FIG. 15 is provided with a contact portion 52*a*, a housing fixing portion 52*b*, an elastic-member attachment portion 52*c* and a board attachment portion 52*d* that are all formed of a flat plate member having a uniform thickness, as the flat plate member is bent in the housing fixing portion 52*b*, the housing fixing portion 52*b* has a press-fitting dimension in the thickness direction slightly larger than the height of a through-hole 56 formed in a housing 51. Even with such structure, the housing fixing portion 52*b* can be pressed into and fixed in the through-hole 56.

Figure 16:
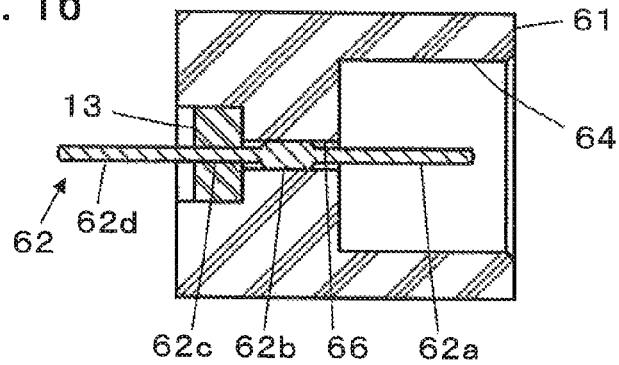
FIG. 16 is a cross-sectional view of a waterproof connector according to another variation of Embodiment 4.

In addition, the contact can be formed of a pin member or a stick-like member in place of a flat plate member. A contact 52 illustrated in FIG. 16 is formed of a pin member having a circular sectional shape, and is provided with a contact portion 52*a*, a housing fixing portion 62*b*, an elastic-member attachment portion 62*c* and a board attachment portion 62*d*, that are formed. continuously at the contact 62 from its tip and to its rear end. On the other hand, the housing fixing portion 62*b* has a larger diameter than diameters of the contact portion 62*a*, the elastic-member attachment portion 62*c* and the board attachment portion 62*d*. The housing fixing portion 62*b* has a diameter designed to be slightly larger than the inner diameter of a through-hole 66 formed in a housing 61 so as to be pressed into and fixed in the through-hole 66.

When the contact 62 formed of a pin member of this type is used, in consideration of contacting with the contact of the counter connector, the contact portion 62*a* is not disposed at the bottom part of a counter-connector receiving portion 64 of the housing 61 but can be projected into the center of the counter-connector receiving portion 64.

Embodiment 5

Figure 17:
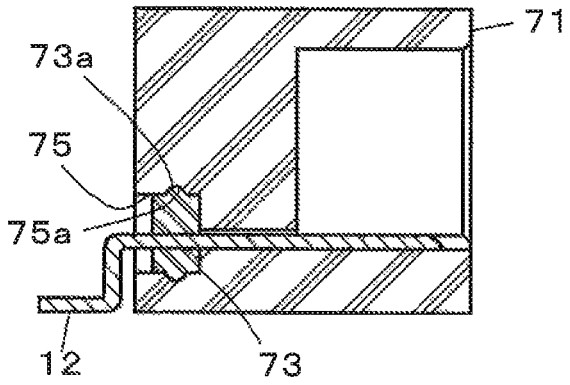
FIG. 17 is a cross-sectional view of a waterproof connector according to Embodiment 5.

FIG. 17 illustrates a structure of a waterproof connector according to Embodiment 5. An elastic member 73 used in the waterproof connector has a convex portion 73*a* on each of the upper surface and the lower surface, whereas an elastic-member accommodation portion 75 of a housing 71 has a concave portion 75*a*, which corresponds to the convex portion 73*a* of the elastic member 73, on each of the ceiling surface and the bottom surface.

Figure 18:
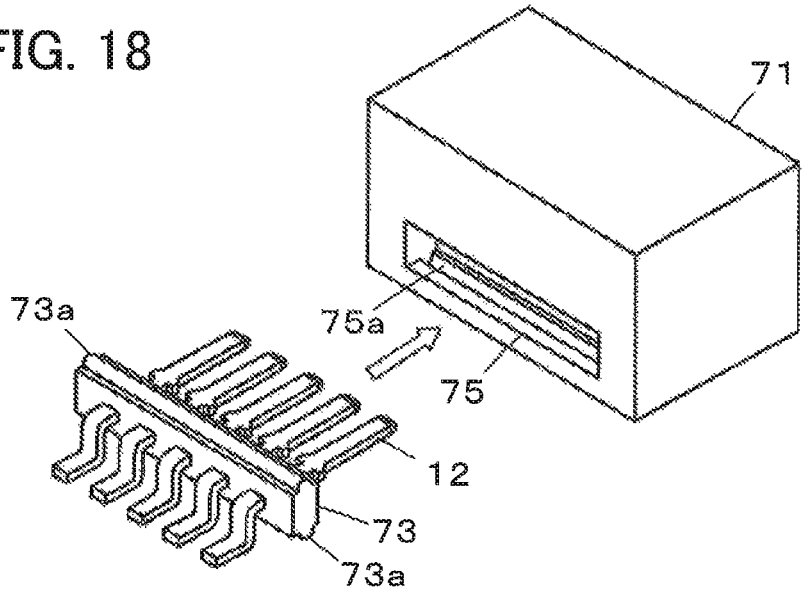
FIG. 18 is a perspective view illustrating how to incorporate contacts into a housing according to Embodiment 5.

As illustrated in FIG. 18, the plurality of contacts 12 with which the elastic member 73 is integrally molded are inserted into the housing 71 through the elastic-member accommodation portion 75 and are pressed into and fixed in corresponding through-holes in the housing 71. At the same time, the elastic member 73 is accommodated in the elastic member accommodation portion 75 of the housing 71 in an elastically compressed state. In this process, as illustrated in FIG. 17, since the convex portions 73*a* of the elastic member 73 are respectively engaged with the concave portions 75*a* of the elastic-member accommodation portion 75 of the housing 71, the elastic member 73 hardly comes off the elastic-member accommodation portion 75, and the contact area between the elastic member 73 and the elastic-member accommodation portion 75 increases, thereby improving the waterproof effect.

Figure 19:
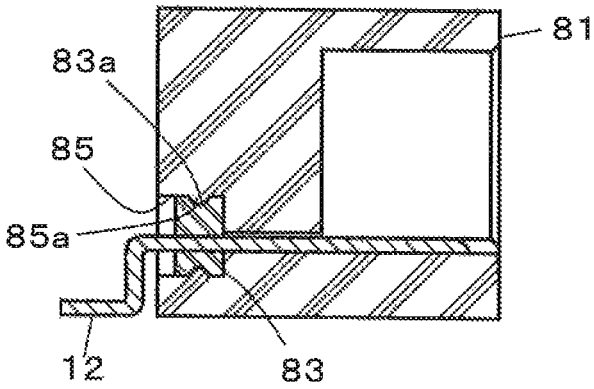
FIG. 19 is a cross-sectional view of a waterproof connector according to a variation of Embodiment 5.
Figure 20:
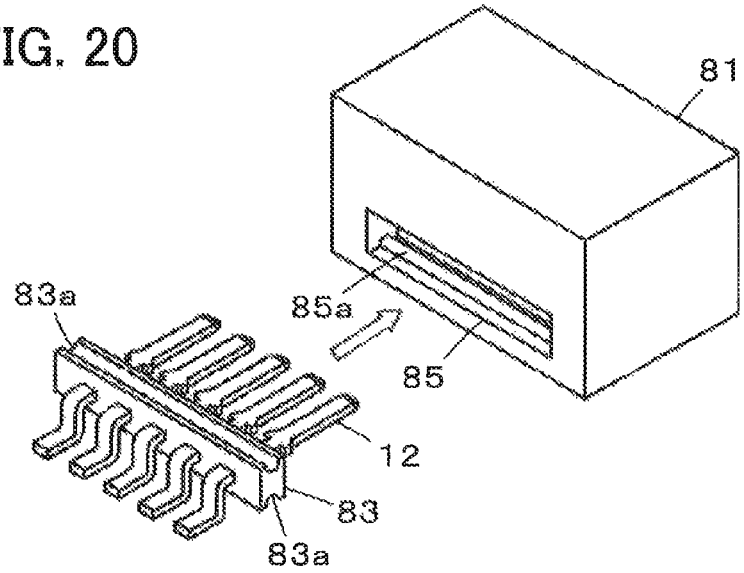
FIG. 20 is a perspective view illustrating how to incorporate contacts into a housing according to the variation of Embodiment 5.

The similar effect can be achieved even when a concave portion 83*a* is formed on each of the upper surface and the lower surface of an elastic member 83 while a convex portion 85*a* is formed on each of the ceiling surface and the bottom surface of an elastic-member accommodation portion 85 of a housing 81, and the elastic portion 83 is accommodated in the elastic-member accommodation portion 85 of the housing 81 in an elastically compressed state in such a manner that the concave portion 83*a* and the convex portion 85*a* are engaged with each other, as illustrated in FIGS. 19 and 20.

Figure 21:
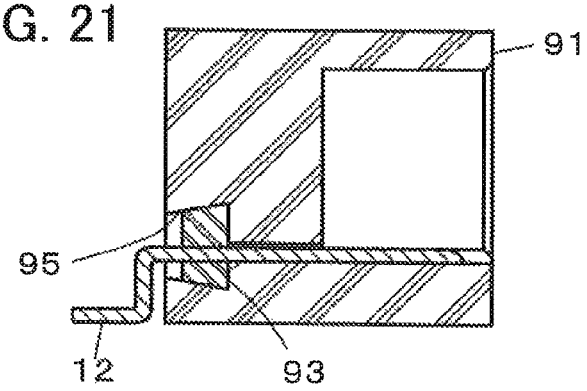
FIG. 21 is a cross-sectional view of a waterproof connector according to another variation of Embodiment 5.
Figure 22:
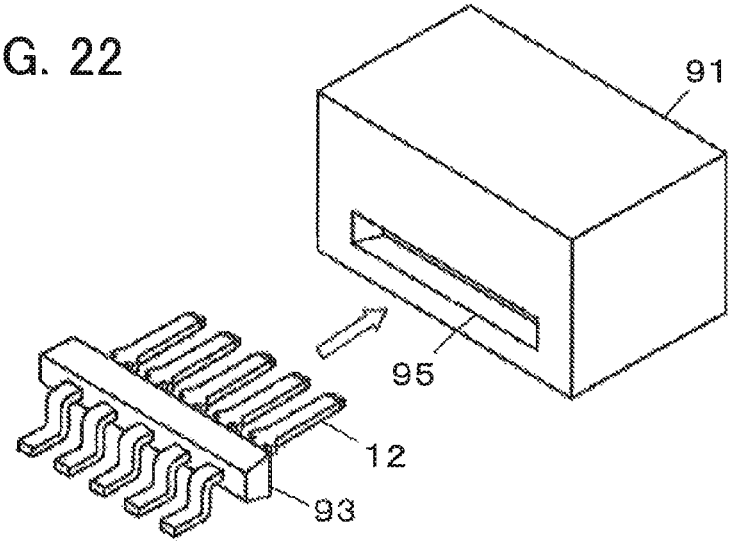

In addition, as illustrated in FIGS. 21 and 22, an elastic-member accommodation portion 95 of a housing 91 can be formed so as to be wider at the end portion than at the opening portion, an elastic member 93 can be formed to have a sectional shape corresponding to the elastic-member accommodation portion 95 of the housing 91, i.e., a sectional shape widening frontward, and the elastic member 93 can be accommodated in the elastic-member accommodation portion 95 of the housing 91 in an elastically compressed state. The elastic member 93 can be prevented from coming off the elastic-member accommodation portion 95 also in this manner.

Other Embodiments

In Embodiment 1 described above, the contact portions 12*a* of the plurality of contacts 12 are respectively accommodated in the plurality of grooves 17 formed in the bottom part of the counter-connector receiving portion 14 in the housing 11. On the other hand, if each of grooves 27 used has a sectional shape that covers both edge portions of the contact portion 12*a* of each of the contacts 12 while allowing the center portion of a surface of the contact portion 12*a* to be exposed as illustrated in FIG. 23, the position of the contact portion 12*a* can be further stabilized, smooth engagement and reliable electrical connection with the counter connector can be achieved.

Although any of the contacts 12, 22, 32, 42 and 52 formed of a flat plate member in Embodiments 1 to 5 described above has a contact portion in a flat plate shape projecting forward, a contact portion can have a curved hook shape like a contact portion 102*a* of a contact 102 illustrated in FIG. 24. When the contact 102 of this type is used, the contact portion 102*a* has spring characteristics attributable to the hook shape, thereby improving reliability in electrical connection with the contact of the counter connector.

In this case, a through-hole 106 in a housing 101 is required to have a sectional shape with which the contact portion 102*a* having a hook shape can be smoothly inserted and, at the same time, a housing fixing portion 102*b* of the contact 102 can be pressed into the through-hole 106.

DESCRIPTION OF SYMBOLS

1, 6 contact, 2 housing, 3 elastic sealing member, 4 through-hole, 5 contact portion, 7 elastic-sealing-member accommodation portion, 11, 41, 51, 61, 71, 81, 91, 101 housing, 11*a* front face, 11*b* rear face, 12, 22, 32, 42, 52, 62, 102 contact, 12*a*, 22*a*, 42*a*, 52*a*, 62*a*, 102*a* contact portion, 12*b*, 22*b*, 42*b*, 52*b*, 62*b*, 102*b* housing fixing portion, 12*c*, 22*c*, 32*c*, 42*c*, 52*c*, 62*c* elastic-member attachment portion, 12*d*, 22*d*, 42*d*, 52*d*, 62*d* board attachment portion, 13, 23, 73, 83, 93 elastic member,14 counter-connector receiving portion, 15, 75, 85, 95 elastic-member accommodation portion, 16, 46, 56, 66, 106 through-hole, 17, 27 groove, 18 casing,19 board, 20 opening portion, 21 gasket,24 attachment hole, 25 slit, 73*a*, 85*a* convex portion,75*a*, 83*a* concave portion, D1 maximum width of housing fixing portion, D2 width of through-hole.

The invention claimed is:

1. A waterproof connector comprising:

a housing;

at least one contact held by the housing, the contact including a contact portion formed at one end of the contact to come into contact with another contact of a counter-connector, a board attachment portion formed at another end of the contact to be attached to a board, a housing fixing portion formed between the contact portion and the board attachment portion and fixed to the housing, and an elastic member attachment portion formed between the housing fixing portion and the board attachment portion; and an elastic member attached to the at least one contact, wherein the housing has at least one through-hole through which the contact is inserted, and an elastic member accommodation portion which has a concave shape and has an opening portion and an end portion formed to be wider than the opening portion, the end portion having a back surface and communicating with the through-hole, wherein the elastic member has a sectional shape which has one end and the other end formed to be wider than the one end corresponding to the elastic member accommodation portion of the housing, and wherein the housing fixing portion of the contact is pressed into and fixed in the corresponding through-hole of the housing, and the elastic member is accommodated through the opening portion in an elastically compressed state in the elastic member accommodation portion of the housing, the other end of the elastic member being located at the end portion while the one end of the elastic member being located near the opening portion.

2. The waterproof connector according to claim 1, wherein the elastic member is integrally molded with the elastic member attachment portion of the contact.

3. The waterproof connector according to claim 1, wherein the elastic member has at least one slit for attaching the elastic member to the elastic member attachment portion of the contact and is attached to the elastic member attachment portion of the contact laterally through the slit that is opened.

4. The waterproof connector according to claim 1, wherein the elastic member attachment portion of the contact has a roughened surface.

5. The waterproof connector according to claim 3, wherein the elastic member is adhered to the elastic member attachment portion of the contact with an adhesive.

6. The waterproof connector according to claim 1, wherein the elastic member attachment portion of the contact has a smaller cross section than cross sections of other portions of the contact adjacent to the elastic member attachment portion.

7. The waterproof connector according to claim 1, wherein the elastic member attachment portion of the contact has a bent portion, and the elastic member is attached to the elastic member attachment portion so as to surround the bent portion.

8. The waterproof connector according to claim 1, wherein the elastic member is singly attached to a plurality of the contacts.

9. The waterproof connector according to claim 1, wherein the contact is formed of a flat plate member, and wherein the housing fixing portion of the contact has a press-fitting dimension in a width direction larger than a width of the through-hole of the housing.

10. The waterproof connector according to claim 9, wherein the housing fixing portion of the contact is provided with convexity and concavity on its side surfaces in a width direction.

11. The waterproof connector according to claim 1, wherein the contact is formed of a flat plate member, and wherein the housing fixing portion of the contact has a press-fitting dimension in a thickness direction larger than a height of the through-hole of the housing.

12. The waterproof connector according to claim 11, wherein the housing fixing portion of the contact is formed to be thicker than other portions of the contact, and the press-fitting dimension is established by a thickness of the housing fixing portion.

13. The waterproof connector according to claim 11, wherein the flat plate member having a uniform thickness is bent, thereby establishing the press-fitting dimension of the housing fixing portion of the contact.

14. The waterproof connector according to claim 1, wherein the housing has at least one groove to accommodate the contact portion of the contact.

15. The waterproof connector according to claim 14, wherein the groove has a sectional shape that covers both edge portions of the contact portion of the corresponding contact while allowing a center portion of a surface of the contact portion to be exposed.

* * * * *